US005269996A

United States Patent [19]

Lee et al.

[11] Patent Number: 5,269,996

[45] Date of Patent: Dec. 14, 1993

[54] PROCESS FOR THE PRODUCTION OF FINE DENIER CELLULOSE ACETATE FIBERS

[75] Inventors: Benedict M. Lee, Kingsport; Charles S. Winebarger, Gray, both of Tenn.

[73] Assignee: Eastman Kodak Company, Rochester, N.Y.

[21] Appl. No.: 943,824

[22] Filed: Sep. 14, 1992

[51] Int. Cl.[5] ..... D01D 10/06; D01F 1/02; D01F 2/30

[52] U.S. Cl. ..... 264/207; 106/184; 106/196; 264/208; 264/210.6; 264/210.8; 264/211; 264/211.11

[58] Field of Search ..... 264/207, 208, 210.6, 264/210.8, 211, 211.11; 106/184, 194, 196

[56] References Cited

U.S. PATENT DOCUMENTS

| | | | |
|---|---|---|---|
| 2,829,027 | 4/1958 | Raynolds et al. | 264/207 X |
| 2,838,364 | 6/1958 | Smith | 264/207 X |
| 3,033,698 | 5/1962 | Kiefer et al. | 264/207 X |
| 3,038,780 | 3/1962 | Kiefer et al. | 264/207 |
| 3,068,063 | 12/1962 | Kiefer et al. | 264/207 |
| 3,080,611 | 3/1963 | Jarrett et al. | 264/207 X |
| 3,382,305 | 5/1968 | Breen | 264/171 |
| 3,608,041 | 9/1971 | Santangelo | 264/207 X |

OTHER PUBLICATIONS

*Japan Textile News*, M. Okamoto, "Ultra-fine Fiber and Its Application", 94 Nov., 1977

*Nippon Nozzle Co., Ltd.*, publication titled "Spinnerettes Nippon Nozzle"

*Primary Examiner*—Leo B. Tentoni

*Attorney, Agent, or Firm*—Mark A. Montgomery; William P. Heath, Jr

[57] ABSTRACT

A method for producing ultra fine denier cellulose acetate fibers that entails spinning a spinning solution containing adequately high amounts of cellulose acetate in acetone wherein the cellulose acetate has a falling ball viscosity of 15 to 70 seconds wherein the spinning is conducted through spinnerettes having holes that have a diameter of less than 36 microns followed by drying at a temperature of about 50° to 80° C. at a draw ratio of 0.9 to 1.7.

15 Claims, No Drawings

PROCESS FOR THE PRODUCTION OF FINE DENIER CELLULOSE ACETATE FIBERS

FIELD OF THE INVENTION

The present invention relates to a process for the production of fine denier cellulose acetate fibers. The present invention more specifically entails the process for producing ultra fine denier cellulose acetate fibers having an average denier per filament of less than 1.4.

BACKGROUND OF THE INVENTION

Cellulose acetate fibers have been used for many years to produce many products such as textile yarns, for making fabrics, and filter tow that is used in the production of filter rods for use in tobacco smoke filters. Cellulose acetate fibers are generally produced by a dry spinning process such as those disclosed in U.S. Pat. No. 2,829,027 and U.S. Pat. No. 2,838,364. The cellulose acetate fibers are generally dry spun from a cellulose acetate spinning solution containing cellulose acetate and acetone with other optional additives such as titanium dioxide. The dry spinning process of producing the cellulose acetate fibers generally produces fibers having an average denier per filament of about 2 to 8. Fine denier filaments of cellulose acetate are more preferred for the manufacture of soft and smooth specialty fabrics. Additionally, when used in tobacco smoke filters, cellulose acetate fibers at the lower range of average denier per filament have a greater surface area exposed to the smoke passing through the filter and thus filtration efficiency is increased. In light of the desirable results obtained from the fine denier cellulose acetate fibers, attempts have been made to commercially manufacture reduced denier per filament fibers. Previous attempts to reduce the average denier per filament of cellulose acetate fibers included reducing the viscosity of the spinning solution or spinning dope by reducing the solids content as disclosed in U.S. Pat. No. 3,033,698. However, spinning of this low viscosity spinning solution tends to cause the extruded fibers to stick to the metal surface of the spinnerettes and is thus it is difficult to pull these fibers into a yarn. Methods of producing lower average denier per filament fibers by lowering the solids content also present flow rate control problems and increase the amount of acetone that needs to be recovered. Another method of reducing the average denier per filament of cellulose acetate fibers entails the modification of the holes in the spinnerettes in addition to lower solids content as disclosed in U.S. Pat. No. 3,608,041.

Other methods of producing fine denier cellulose acetate fibers that also entail reducing the viscosity of the solution by reducing solids, correct the stickiness problems by adding metal chelates to the spinning solution such as disclosed in U.S. Pat. No. 3,033,698, U.S. Pat. No. 3,038,780, and U.S. Pat. No. 3,068,063. However, acetone recovery is still a problem and the long term toxicity of these metal chelates is not known, thus these products are not acceptable for tobacco smoke filters. Also end users are reluctant to use fibers with unusual additives.

Another method of reducing the average denier per filament of the fiber entails increasing the draw ratio, however, when producing fine denier fibers by simply increasing the draw ratio, breakage of the filaments is unacceptably high.

It would be very desirable to be able to produce ultra fine denier filaments using a spinning solution of normal to high solids content without dramatically changing spinning conditions or the addition of unusual additives.

SUMMARY OF THE INVENTION

The process of the present invention entails the production of ultra fine denier cellulose acetate fibers according to the process that comprises:

(A) forming a spinning solution containing about 24 up to 32 weight percent cellulose acetate, 0 up to a minor amount of $TiO_2$, a minor amount of water, with the remainder being acetone, wherein said cellulose acetate has a falling ball viscosity of 15 to 70 seconds;

(B) spinning said spinning solution at an elevated temperature through spinnerettes having a multiplicity of holes having a diameter less than 36 microns to form a fiber;

(C) drying said fibers in a gaseous media that is at a temperature of about 50° to 80° C. wherein said fibers are spun at a draw ratio of about 0.9 to 1.7 thereby producing fibers having an average denier per filament of less than 1.4.

DETAILED DESCRIPTION OF THE INVENTION

The applicants have unexpectedly discovered an improved process for producing ultra fine denier fibers that have an average denier per filament of less than 1.4 that does not require the addition of unusual additives, reduced solids, or dramatic changes in spinning conditions. This process of producing ultra-fine denier fibers is possible due to the normal to high solids content spinning solution containing a cellulose acetate that has a falling ball viscosity of 15 to 70 seconds that is spun through spinnerettes having a diameter less than 36 microns at the defined drying or curing conditions.

In the process of the present invention for producing the ultra fine denier cellulose acetate fibers, a spinning solution is formed containing 24 to 32 weight percent cellulose acetate, 0 up to a minor amount of $TiO_2$, a minor amount of water with the remainder being acetone wherein the cellulose acetate has a falling ball viscosity of 15 to 70 seconds. This spinning solution is preferably formed at room temperature up to the boiling point of the solution, more preferably between 30° and 50° C. Mixing the spinning solution at temperatures much below room temperature does not adequately permit the formation of a homogenous mixture of acetone and cellulose acetate whereas temperatures above the boiling point of acetone in the solution are clearly undesirable.

The solids content of the spinning solution is generally between 24 and 32 weight percent cellulose acetate with zero to very minor amounts of titanium dioxide. The cellulose acetate content is preferably above 25 up to 32 weight percent, more preferably about 26 to 30 weight percent. At the higher solids content, there is less acetone present in the spinning solution, thus the need for acetone recovery is reduced. However, at a solids content much above 32 weight percent, the spinning solution is too viscous to be extruded through the small spinnerette holes. Whereas, at a solids content much below 25 weight percent, the flow rate of the dope through the spinnerette is difficult to control and the amount of acetone to recover is too high. Additionally, spinning solutions containing low solids when spun into fibers tend to cause the fibers to stick to the outside surface of the metal face of the spinnerettes and are, therefore, difficult to pull the filaments into a yarn.

The cellulose acetate used in the spinning solution has a falling ball viscosity that is preferably below 42 seconds, more preferably below 35 seconds. Falling ball viscosity is defined as the time in seconds for a stainless steel ball of ⅛ inch in diameter (3.17 mm) to pass between two sets of parallel and horizontal lines separated by 2.25 inches (5.71 cm) through a solution of 20 weight percent cellulose acetate and 80 weight percent acetone at 25° C. Falling ball viscosity is generally reduced by lowering the average molecular weight of cellulose acetate. The molecular weight of cellulose acetate may be adjusted by proper selection of esterification conditions by those skilled in the art. The falling ball viscosity for this cellulose acetate is in the preferred range of 20 to 42 seconds with a range of 25 to 40 seconds being more preferred. Cellulose acetates of falling ball viscosities higher than 42 seconds are less desirable since the resulting spinning solution becomes too viscous to adequately extrude through the fine diameter holes in the spinnerettes. However, a cellulose acetate that has a falling ball viscosity much below 15 seconds, when formed into a spinning solution, results in a spinning solution of too low a viscosity to permit fiber formation out of the end of the holes in the spinnerettes. The inherent viscosity of the cellulose acetate in the spinning solution is preferably about 1.35 to 1.60 more preferably about 1.45 to 1.58 with a cellulose acetate inherent viscosity below about 1.56 being most preferred.

The spinning solution according to the present invention generally has minor amounts of titanium dioxide added and minor amounts of water. The amount of $TiO_2$ in the total spinning solution is generally below one weight percent, more preferably below 0.5 weight percent, with a weight percent of $TiO_2$ less than 0.3 weight percent being most preferred. A minor amount of $TiO_2$ is added to increase the whiteness of the resulting filter tow whereas higher amounts of $TiO_2$ tend to plug the fine spinnerette holes.

The amount of water present in the spinning solution of the present invention is generally less than 3 weight percent, more preferably between about 1 and 2 weight percent. Amounts of water much above 3 weight percent tend to slow the drying time of the resulting fibers whereas amounts of water much below about 1 weight percent are difficult to obtain since the acetone is recycled from water by distillation and ambient air is humid.

The spinning solution is spun according to the present invention at an elevated temperature through the holes in the spinnerettes that have a diameter of less than 36 microns to form a fiber. The spinning temperature of the spinning solution in the process of the present invention is preferably as hot as possible but below the boiling point of acetone. The elevated temperature of the spinning solution is maintained by passing through a heated candlefilter. The candlefilter temperature is maintained by passing hot water through the internal channels of the candlefilter. The actual temperature of the spinning solution is a few degrees below the candlefilter water temperature. This hot water temperature is preferably between 4° and 65° C. with a temperature of about 50° to 60° C. being more preferred. Candlefilter water temperatures much above 65° C. can heat the spinning solution above the boiling point of the acetone and tend to cause the formation of bubbles on the surface of the extruded fibers. However, candlefilter water temperatures much below 40° C. causes the viscosity of the spinning solution to be too high and also lengthens the curing or drying time of the spun fiber.

The holes in the spinnerettes used in the process of the present invention can be of any shape. However, these holes are preferably round due to the ease in manufacturing of round holes in spinnerettes. Additionally fibers produced by extrusion through non-round holes tend to have an increased pressure drop when used in a tobacco smoke filter. This increased pressure drop is such that the same unit pressure drop for a fiber from a round spinnerette hole produces higher filtration efficiency than that of the fibers from a non round spinnerette hole cross section, such as a Y cross section.

The diameter of the holes in the spinnerettes used in the process of the present invention are preferably between 20 and 36 microns. In general, smaller hole sizes are required to spin fibers having lower average denier per filament. When producing cellulose acetate fibers having an average denier per filament of about 1.2, the diameter of the holes in the spinnerettes is more preferably 28 to 34 microns with a diameter of about 30 to 32 microns being most preferred.

The spinnerettes of the present invention preferably have a round hole profile such that the conical section in the back of the hole gradually tapers to form a cylindrical hole at the exit of the spinnerette. The round hole profiles are more preferably selected from hyperbola and multi angle hole profiles. The surfaces of the spinnerette holes are preferably extremely smooth. These spinnerette holes more preferably have a surface roughness less than 0.05 $R_a$ microns. $R_a$ indicates the arithmetic roughness average of the surface.

The spinnerettes of the present invention are preferably of improved quality compared to the quality of spinnerettes acceptable for producing fibers of cellulose acetate having filament size in the range of 2 to 8 denier per filament. This improved quality is especially manifest in the uniform and symmetrical shape of holes having extremely smooth surface finish. The holes at the exit of the spinnerette have cylindrical shape of about 30 microns in diameter and lengths which may be selected within the range of about 0.5 to about 1.5 times the diameter of the hole. The improved quality spinnerette holes preferably have cylindrical sections with a surface roughness of 0.005 to 0.025 $R_a$ microns. The upstream portion of the spinnerette holes is commonly known as the countersink and has a profile which gradually increases for the diameter of the cylindrical hole section by gradually increasing the angle that the wall of the countersink makes with the axis of the hole. This may be accomplished by having a continuously increasing angle of the countersink wall with a profile such as that of a parabola. Alternatively, the countersink may be comprised of multiple frustoconical sections in which the apex angles of the sections increase as the diameter of frustoconical profile increases. For example, for two frustoconical sections, the smallest frustoconical section adjacent to and immediately upstream from the cylindrical section may have an apex angle in the range of 10 to 30 degrees and the length of said section may be 3 to 10 times the diameter of the cylindrical section of the spinnerette hole. For the frustoconical section next farther upstream, the apex angle of said section may be in the range of 40 to 70 degrees and the length may be greater than 10 times the diameter of the cylindrical section of the spinnerette hole. The frustoconical sections of improved quality spinnerette holes preferably have a surface roughness within the range of 0.025 to 0.050 $R_a$ microns. The exterior surface or face of the improved quality spinnerette preferably has a surface roughness of 0.005 to 0.025 $R_a$ microns.

By contrast, spinnerettes that are acceptable for producing cellulose acetate fibers having a denier per filament in the range of 2 to 8 when a single countersink of frustoconical section can have an apex angle of 40 to 70 degrees. The smoothness of the finish of surfaces of the cylindrical holes, the frustoconical section and the exterior face of these spinnerettes is not as important as that of spinnerettes employed for producing fiber having less than 1.4 denier per filament.

The fiber that is spun through the spinnerette holes is dried or cured in a gaseous media at a temperature of about 50° to 80° C. This drying is preferably conducted in a drying cabinet with a lower top air temperature and a higher bottom air temperature of about 60° to 110° C. These temperatures are more preferably 60° to 70° C. for the top and 70° to 100° C. for the bottom with a bottom cabinet temperature of about 80° to 90° C. being most preferred.

The spun fibers, prior to complete curing or drying, are spun at a draw ratio (winding speed/extrusion speed) of 0.9° to 1.7, more preferably about 1 to 1.6 with a draw ratio of about 1.2 to 1.5 being most preferred. At draw ratios much below 0.9 the fibers tend to flutter together and stick since the shrinking fiber does not make up for the reduced take up speed. Whereas draw ratios much above 1.7 cause fiber breakage due to the significant stretching of fibers. It is preferred that the draw ratio generally be higher than 1 to help lower the denier, thus a draw ratio of about 1.2 to 1.5 is most preferred.

The ultra fine denier cellulose acetate fibers provided according to the present invention generally have an average denier per filament of less than about 1.4 more preferably less than 1.2. The fibers produced according to the present invention generally have an average denier per filament range of about 0.6 to 1.4 more preferably 1.0 to about 1.4 with an average denier per filament of about 1.0 to 1.2 being most preferred. Average denier per filaments of greater than 1.4 do not adequately increase the filtration efficiency of filter products to be of great benefit. Whereas, an average denier per filament much below 1.0 does not significantly increase filtration efficiency to match the increased pressure drop across a filter.

The following examples are to illustrate the present invention but should not be intended to limit the reasonable scope thereof.

EXAMPLES

Example I

A spinning solution was formed by mixing at a temperature of about 35° C. 26.4 wt. percent cellulose acetate, 0.133 wt. percent titanium dioxide, less than 2 wt. percent water and the remainder being the solvent, acetone. The cellulose acetate had a falling ball viscosity of 40 seconds and an acetyl content of 39.5 wt. percent. This spinning solution was filtered and was spun through 30 and 32 μm round hole dry spinnerettes from Nippon Nozzle Ltd., there being 450 holes in each spinnerette, and the holes being of improved surface finish with multiple conical taper leading to the final cylindrical holes as described above. A total denier of 515 and 520 were obtained at the speed of 466 m/m and 453 m/m, respectively. The spinning draws were 1.54 and 1.35 and denier per filaments were 1.4 and 1.16 for these respective runs. The candlefilter water temperature was set at 55° C., top air temperature was set at 75° C., and bottom air temperature was set at 90° C. for both spinning runs. Spinning performance was satisfactory and yarn quality was satisfactory at these speeds. At these spinning conditions, a few yarn packages were successfully spun. The spinning performance of the 32 μm diameter hole spinnerette was better than that of the 30 μm diameter hole spinnerette.

Example II

A spinning solution was formed as described in Example I. This spinning solution was filtered and spun through a spinnerette having 450 round holes of 32 μm diameter and improved hole quality as described in Example I. The 450 filament strand had total denier of 532, an average of 1.20 denier per filament and a calculated spin draw of 1.52. The spinning speed was 525 m/m, and other spinning conditions were like those described in Example I. One hundred and sixteen package strands of fiber were wound. Filter tows were made by combining 56 package strands to make a crimped tow of about 30,000 total denier. These tows were processed into filter rods on a miniature/PM-2 plugmaker machine. Pressure drop generation of filter rods was measured on a Filtrona APD 2-V machine. Filters with 23.95 mm circumference and 31.5 mm length were cut from the rods, and they were attached to commercial cigarette tobacco columns. These cigarettes with 1.2 denier per filament tow filters were tested for filtration efficiency by the FTC method. These results are shown in Table 1.

TABLE 1

| Tow Item | Rod Dimension | Rod P.D. | Rod Wt. |
|---|---|---|---|
| 1.2/30,000/Reg. | 24.45 mm Cir. × 126 mm L. | 490 mm | 580 mg |
| 1.2/30,000/Reg. | 24.45 mm Cir. × 126 mm L. | 685 mm | 660 mg |
| 3.0/35,000/Y | 24.45 mm Cir. × 126 mm L. | 280 mm* | 580 mg |
| 3.0/35,000/Y | 24.45 mm Cir. × 126 mm L. | 379 mm* | 660 mg |

| Filter Dimension | Filter P.D. | Tar Fil. Eff. |
|---|---|---|
| 24.45 mm × 31.5 mm L. | 122.5 mm | 65.8% |
| 24.45 mm × 31.5 mm L. | 171.5 mm | 74.5% |
| 24.45 mm × 31.5 mm L. | 122.5 mm | 58.0%* |
| 24.45 mm × 31.5 mm L. | 171.5 mm | 64.4%* |

*Theoretical values based on mathematical models.

As shown in this example, the pressure drop generation and filtration efficiencies of 1.2 denier regular round cross section filter tow are significantly higher than 3.0 denier Y cross section filter tow which is more commonly used in cigarette filters.

Example III

A portion of the spinning solution prepared in Example II was used to spin fiber through spinnerettes having round holes of 32 μm diameter and having normal surface finish and the single-conical taper leading to the final cylindrical holes at the exits of the spinnerette face. Fiber was able to be produced, however the frequencies of breaks indicate that satisfactory commercial spinning could not be achieved at any of several spinning conditions of winding speed in the range of 400 to 600 m/m and of candle filter water temperatures in the range of 50° to 65° C.

Example IV

A spinning solution was formed by mixing at a temperature of about 35° C. 27.1 wt. percent cellulose acetate, 0.133 wt. percent titanium dioxide, less than 2 wt. percent water and the remainder being the solvent, acetone. The cellulose acetate had a falling ball viscosity of 37 seconds and an acetyl content of 39.5 wt. percent. This spinning solution was filtered and was spun through a 32 μm round hole spinnerette, there being 450 holes in the spinnerette and the holes being of improved surface finish with multiple conical taper leading to the final cylindrical holes as described in Example I. A total denier of 539 was obtained at the speed of 710 m/m. The calculated spinning draw was 1.56 and the average denier per filament was 1.20. The candle filter water temperature was set at 60° C., the top air temperature was set at 70° C., and the bottom air temperature was set at 90° C. Even with this relatively high level of cellulose acetate concentration in the spinning solution and relatively high spinning speed, the spinning performance was satisfactory and about 90 packages of fiber with each having 3.4 pounds of fiber were spun. A bundle of 56 package strands were crimped into a tow on a crimper. Satisfactory crimped tows were made and these tows were processed into filter rods on a miniature/PM 2 plugmaker without any difficulty. Pressure drop of filter rods was measured on a Filtrona APD 2-V machine, and filtration efficiencies of 15 mm filters were measured by the FTC method. Cigarettes were smoked on the smoking machine up to 23 mm from the mouth end of the cigarette to measure the filtration efficiencies. The pressure drop measurement and filtration efficiencies results are shown in Table 2.

TABLE 2

| Tow Item | Rod Dimension | Rod P.D | Rod Wt. |
|---|---|---|---|
| 1.2/30,000/Reg. | 23.95 mm Cir. × 120 mm L. | 622 mm | 640 mg |
| 1.2/30,000/Reg. | 23.95 mm Cir. × 120 mm L. | 800 mm | 877 mg |
| 3.0/35,000/Y | 23.95 mm Cir. × 120 mm L. | 423 mm | 640 mg |
| 3.0/35,000/Y | 23.95 mm Cir. × 120 mm L. | — | 877 mg** |

| Filter Dimension | Filter P.D. | Tar Fil. Eff. |
|---|---|---|
| 23.95 mm × 15 mm L. | 78 mm | 45.2% |
| 23.95 mm × 15 mm L. | 114 mm | 52.5% |
| 23.95 mm × 15 mm L. | 78 mm | 42.0% |
| 23.95 mm × 15 mm L. | 114 mm | 45.9%* |

*Theoretical values based on mathematical models.
**Not achievable weight for the size of rod.

As shown in Table 2, significant increases of pressure drop generation and filtration efficiencies were observed when compared with a conventional filter material.

Example V

A spinning trial was performed to optimize the spinning condition for making ultra fine denier filaments. A fractional factorial experiment was performed with 6 spinning variables such as denier per filament, candlefilter water temperature, cabinet top air temperature and flow rate, and cabinet bottom air temperature and flow rate. In this experiment, a regular spinning solution which had 26.4 weight percent cellulose acetate, 0.113 weight percent $TiO_2$, less than 2 wt. percent water and the remainder being the solvent, acetone, was used. At each spinning condition, maximum spinning speed was measured by increasing the godet roll speed gradually until the bundle of filaments started to generate broken filament. The maximum spinning speeds obtained were fitted to a regression model as follow:

$$\text{Maximum Spinning speed} = 476.2 + 102.9 \times DPF - 14.9 \times \text{Top Air Temp.} + 2.1 \times \text{Candlefilter Temp.} - 5.4 \times \text{Top Air Temp.} \times \text{Candlefilter Temp.}$$

The coefficient of correlation ($R^2$) was 0.995. This regression model showed that the lower denier per filament is more difficult to spin, and low top air temperature is preferred for spinning low denier per filament cellulose acetate fiber.

The spinning trials in the examples proved that ultra fine denier acetate fiber can be spun without reducing the solids level of the spinning solution. For spinning ultra fine denier fiber, it is essential to reduce the cellulose acetate I.V. or falling ball viscosity low enough to make a spinning solution with a viscosity below the level obtained by reduced solids spinning solution. Our spinning trials were confined to 1.2 denier per filament fiber, but it is possible to spin lower than 1.2 denier without changing the dope solids, if the acetate I.V. is lowered below 1.56 but not lower than about 1.35. An acetate I.V. lower than about 1.35 would make yarn tensile property unacceptably low.

We claim:

1. A process for the production of ultra fine denier cellulose acetate fibers comprising:

(A) forming a spinning solution containing above 25 up to 32 weight percent cellulose acetate, 0 up to a minor amount of $TiO_2$, a minor amount of water with the remainder being acetone, wherein said cellulose acetate has a falling ball viscosity of 15 to 70 seconds;

(B) spinning said spinning solution a an elevated temperature through spinnerettes having a multiplicity of holes having a diameter less than 36 microns to form fibers;

(C) drying said fibers in a gaseous media that is at an initial temperature of about 50° to 80° C. wherein said fibers are spun at a draw ratio of about 0.9 to 1.7 thereby producing fibers having an average denier per filament of less than 1.4.

2. The process according to claim 1 wherein the spinning solution contains above 25 up to 32 weight percent cellulose acetate, 0 up to 1 weight percent $TiO_2$, up to 3 weight percent water, and about 64 to 76 weight percent acetone, wherein said cellulose acetate has a falling ball viscosity of less than 42 seconds.

3. The process according to claim 2 wherein said cellulose acetate has a falling ball viscosity of no more than 35 seconds.

4. The process according to claim 1 wherein the spinning solution contains about 26 to 30 weight percent cellulose acetate.

5. The process according to claim 1 wherein said spinning is conducted at an elevated temperature below the boiling point of acetone through spinnerettes having a multiplicity of round holes having a diameter of 20 to less than 36 microns.

6. The process according to claim 5 wherein the holes of said spinnerettes have a diameter between 28 and 34 microns.

7. The process according to claim 1 wherein said spinnerettes have a round hole profile such that the conical section in the back of the hole gradually tapers to form a cylindrical hole at the exit of the spinnerette.

8. The process according to claim 7 wherein said round hole profiles are selected from the group consisting of hyperbola and multi angle hole profiles.

9. The process according to claim 1 wherein the surface of the spinnerette holes are extremely smooth.

10. The process according to claim 9 wherein said spinnerette holes have a surface roughness of 0.01 to 0.05 $R_a$ microns.

11. The process according to claim 1 wherein said gaseous media is air and said fibers are dried in a cabinet that has a lower top air temperature and a higher bottom air temperature of about 60° to 110° C.

12. The process according to claim 11 wherein said drying is conducted in a spinning cabinet with a top air temperature of about 60° to 70° C. and a bottom air temperature of about 70° to 100° C.

13. The process according to claim 1 wherein said draw ratio is about 1.2 to 1.5.

14. The process according to claim 1 wherein said fibers have an average denier per filament of about 0.6 to 1.4.

15. The process according to claim 14 wherein said fibers have an average denier per filament of 1.0 to 1.3.

* * * * *